US012757942B2

(12) United States Patent
Ou

(10) Patent No.: US 12,757,942 B2
(45) Date of Patent: Oct. 13, 2026

(54) ELECTRONIC VAPORIZATION DEVICE AND VAPORIZER THEREOF

(71) Applicant: Shenzhen Verdewell Technology Limited, Shenzhen (CN)

(72) Inventor: Guoliang Ou, Shenzhen (CN)

(73) Assignee: Shenzhen Verdewell Technology Limited, Shenzhen (CN)

( * ) Notice: Subject to any disclaimer, the term of this patent is extended or adjusted under 35 U.S.C. 154(b) by 390 days.

(21) Appl. No.: 18/461,260

(22) Filed: Sep. 5, 2023

(65) Prior Publication Data

US 2024/0074508 A1 Mar. 7, 2024

(30) Foreign Application Priority Data

Sep. 7, 2022 (CN) ..... 202222386311.9

(51) Int. Cl.
*A24F 40/48* (2020.01)
*A24F 40/10* (2020.01)
*A24F 40/46* (2020.01)

(52) U.S. Cl.
CPC ..... *A24F 40/48* (2020.01); *A24F 40/46* (2020.01); *A24F 40/10* (2020.01)

(58) Field of Classification Search
CPC ..... A24F 40/30; A24F 40/20; A24F 40/44; A24F 40/10; A24F 40/42
See application file for complete search history.

(56) References Cited

U.S. PATENT DOCUMENTS 11,109,620 B1 9/2021 Arnel et al.
2015/0157055 A1 6/2015 Lord
2016/0044965 A1* 2/2016 Liu ..... A24F 40/50 392/394
2016/0338411 A1 11/2016 Liu
2017/0325289 A1 11/2017 Liu
2020/0221773 A1* 7/2020 An ..... H05K 1/181
2022/0022539 A1* 1/2022 Rado ..... A24F 40/485
2022/0279856 A1 9/2022 Zhou et al.
2022/0287363 A1 9/2022 Liu
2023/0088232 A1 3/2023 Xiao
(Continued)

FOREIGN PATENT DOCUMENTS

CN 205284994 U 6/2016
CN 205567812 U 9/2016
(Continued)

OTHER PUBLICATIONS

Patent Cooperation Treaty, International Search Report and Written Opinion, International Application No. PCT/CN2022/117663 (Jun. 5, 2023).

(Continued)

*Primary Examiner* — Alex B Efta

(74) *Attorney, Agent, or Firm* — Leydig, Voit & Mayer, Ltd.

(57) ABSTRACT

A vaporizer includes: a base; an electrode column inserted in the base in a longitudinal direction; and an insulating sleeve disposed between the electrode column and the base so as to electrically insulate the electrode column from the base. A side opening is provided in a side wall of the insulating sleeve, the side opening running through an inner side and an outer side of the side wall and through both ends of the insulating sleeve.

16 Claims, 6 Drawing Sheets

(56) References Cited

U.S. PATENT DOCUMENTS

| | | | | |
|---|---|---|---|---|
| 2024/0074508 | A1 | 3/2024 | Ou | |
| 2024/0081408 | A1 * | 3/2024 | Yamada | H05B 6/108 |

FOREIGN PATENT DOCUMENTS

| | | | |
|---|---|---|---|
| CN | 206791638 | U | 12/2017 |
| CN | 208446620 | U | 2/2019 |
| CN | 106263036 | B | 3/2019 |
| CN | 110506993 | A | 11/2019 |
| CN | 215958332 | U | 3/2022 |
| CN | 114680382 | A | 7/2022 |
| CN | 114680389 | A | 7/2022 |
| CN | 114680392 | A | 7/2022 |
| WO | 2020183780 | A1 | 9/2020 |
| WO | 2022141547 | A1 | 7/2022 |
| WO | 2022141555 | A1 | 7/2022 |
| WO | 2022141556 | A1 | 7/2022 |
| WO | 2022141557 | A1 | 7/2022 |
| WO | 2022141558 | A1 | 7/2022 |
| WO | 2022141566 | A1 | 7/2022 |

OTHER PUBLICATIONS

U.S. Patent and Trademark Office, Office Action in U.S. Appl. No. 18/461,319 (Mar. 26, 2026).
U.S. Patent and Trademark Office, Office Action in U.S. Appl. No. 18/461,345 (Feb. 24, 2026).
U.S. Patent and Trademark Office, Office Action in U.S. Appl. No. 18/461,345 (Jul. 30, 2026).
U.S. Patent and Trademark Office, Office Action in U.S. Appl. No. 18/461,230 (Jul. 21, 2026).

* cited by examiner

ELECTRONIC VAPORIZATION DEVICE AND VAPORIZER THEREOF

CROSS-REFERENCE TO PRIOR APPLICATION

Priority is claimed to Chinese Patent Application No. 202222386311.9, filed on Sep. 7, 2022, the entire disclosure of which is hereby incorporated by reference herein.

FIELD

The present application relates to the field of vaporization, and more specifically, to an electronic vaporization device and a vaporizer thereof.

BACKGROUND

An electronic vaporization device is configured to heat and vaporize a vaporizable liquid medium to generate inhalable aerosols. The electronic vaporization device generally includes a vaporizer and a power supply device. The power supply device is configured to supply power to the vaporizer. The vaporizer is configured to accommodate a liquid medium, and heat and vaporize the liquid medium after energized. As a main structure of the vaporizer, a vaporization core is generally connected to an external power supply through an electrode column inserted in a base. In general, an insulating sleeve is sleeved outside the electrode column, to ensure the electrical insulation and sealed connection between the electrode column and the base. However, the structure is inconvenient to assemble.

SUMMARY

In an embodiment, the present invention provides a vaporizer, comprising: a base; an electrode column inserted in the base in a longitudinal direction; and an insulating sleeve disposed between the electrode column and the base so as to electrically insulate the electrode column from the base, wherein a side opening is provided in a side wall of the insulating sleeve, the side opening running through an inner side and an outer side of the side wall and through both ends of the insulating sleeve.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
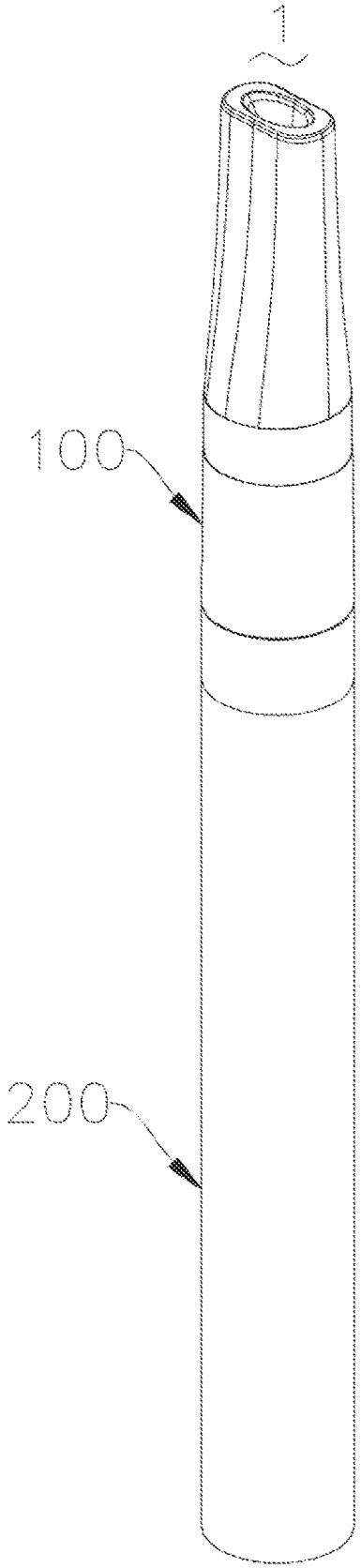
FIG. 1 is a schematic diagram of a three-dimensional structure of an electronic vaporization device in some embodiments of the present application.

In an embodiment, the present invention provides an improved vaporizer and an electronic vaporization device having same to overcome the foregoing defects in the related art.

In an embodiment, the present invention provides a vaporizer, including:

a base;

an electrode column, inserted into the base in the longitudinal direction; and an insulating sleeve, disposed between the electrode column and the base, to enable the electrode column and the base to be electrically insulated, wherein a side opening is provided in the side wall of the insulating sleeve, and the side opening runs through the inner side and the outer side of the side wall and runs through both ends of the insulating sleeve.

In some embodiments, the extension direction of the side opening is parallel to the extension direction of the insulating sleeve. In some embodiments, at least one vent passage is formed on the insulating sleeve.

In some embodiments, the at least one vent passage includes a plurality of vent passages, and the plurality of vent passages are evenly arranged at intervals along a circumferential direction of the insulating sleeve.

In some embodiments, the at least one vent passage includes at least one vent groove formed on the inner wall surface of the insulating sleeve.

In some embodiments, the upper end of the electrode column extends out of the insulating sleeve. An annular vent gap is formed between the outer wall surface of the upper end of the electrode column the inner wall surface of the base. The at least one vent passage communicates with the vent gap.

In some embodiments, the outer wall surface of the electrode column protrudes outward to form a flange. The flange abuts against the upper end surface of the insulating sleeve.

In some embodiments, the vaporizer further includes a shell, a vent tube inserted into the shell, and a vaporization core disposed in the vent tube. The base is at least partially inserted into the lower end of the shell. One pole of the vaporization core is electrically connected to the electrode column.

In some embodiments, the lower end of the vent tube is inserted into the base.

In some embodiments, the vent tube and the base may be electrically conductive. The other pole of the vaporization core is electrically connected with to the vent tube and the base.

The present application further provides an electronic vaporization device, including the vaporizer according to any one of the above. Implementation of the present application at least has the following beneficial effects: The provision of the side opening in the side wall of the insulating sleeve enables the insulating sleeve to be easily fitted onto the electrode column, making the assembly more convenient.

To bring a clearer understanding of the technical features, objectives, and effects of the present application, specific embodiments of the present application are described in detail with reference to the accompanying drawings. In the following description, many specific details are set forth for thorough understanding of the present application. However, the present application may be implemented in many other manners different from those described herein. A person skilled in the art may make similar modifications without departing from the connotation of the present application. Therefore, the present application is not limited to the specific embodiments disclosed below.

In description of the present application, it should be understood that orientation or position relationships indicated by the terms such as "longitudinal", "transverse", "width", "thickness", "front", "back", "upper", "lower", "left", "right", "top", "bottom", "inside", and "outside" are based on orientation or position relationships shown in the accompanying drawings or orientation or position relationships that are generally placed when a product of the present application is used, and are used only for ease of describing the present application and simplifying description, rather than indicating or implying that the mentioned device or element must have a particular orientation or must be constructed and operated in a particular orientation. Therefore, such terms should not be construed as limiting the present application.

In addition, terms "first" and "second" are used merely for the purpose of description, and cannot be construed as indicating or implying relative importance or implying the quantity of indicated technical features. Therefore, a feature restricted by "first" or "second" may explicitly indicate or implicitly include at least one such feature. In the descriptions of the present application, unless explicitly specified, "plurality of" means at least two, for example, two or three.

In the present application, unless explicitly specified and defined, the terms "mount", "connect", "connection", and "fix" should be understood in a broad sense. For example, a connection may be a fixed connection, a detachable connection, or an integral connection; or the connection may be a mechanical connection or an electrical connection; or the connection may be a direct connection, an indirect connection through an intermediary, or internal communication between two elements or mutual action relationship between two elements, unless otherwise specified explicitly. A person of ordinary skill in the art can understand specific meanings of the terms in the present application according to specific situations.

In the present application, unless explicitly specified or defined, that a first feature is "on" or "under" a second feature may indicate that the first feature is in a direct contact with the second feature, or the first feature is in an indirect contact with the second feature through an intermediary. In addition, that the first feature is "above" the second feature may indicate that the first feature is directly above or obliquely above the second feature, or merely indicate that the horizontal height of the first feature is higher than that of the second feature. That the first feature is "below" the second feature may be that the first feature is right below or obliquely below the second feature, or may merely indicate that a horizontal position of the first feature is lower than that of the second feature.

Figure 2:
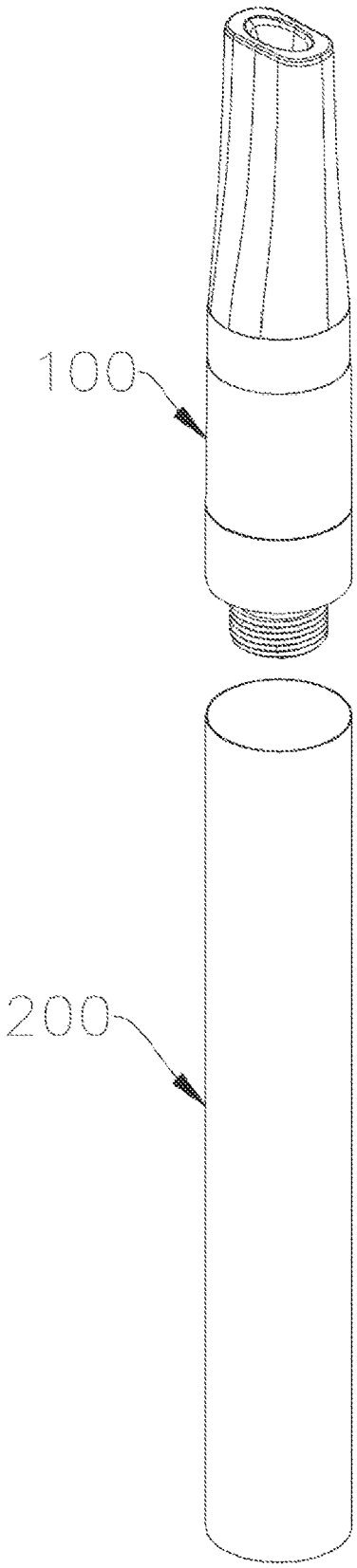
FIG. 2 is a schematic diagram of an exploded structure of the electronic vaporization device shown in FIG. 1.

FIG. 1 and FIG. 2 show an electronic vaporization device 1 in some embodiments of the present application. The electronic vaporization device 1 includes a vaporizer 100 and a power supply device 200 matched with and connected to the vaporizer 100. The power supply device 200 is configured to supply power to the vaporizer 100, and may control operations such as opening and closing of the entire electronic vaporization device 1. The vaporizer 100 is configured to accommodate a liquid medium and heat and vaporize the liquid medium after being powered on to generate aerosols. In some embodiments, both the vaporizer 100 and the power supply device 200 may have a roughly cylindrical structure, and may be mechanically and electrically connected in the axial direction. Further, the vaporizer 100 and the power supply device 200 may be detachably connected together in a threaded connection manner. It may be understood that in other embodiments, the vaporizer 100 and the power supply device 200 may alternatively be connected together in other detachable manners such as magnetic connection, snap-fit connection. Alternatively, the vaporizer 100 and the power supply device 200 may be connected together in a non-detachable manner. In addition, the cross-sectional shape of the vaporizer 100 and/or the power supply device 200 is not limited to being circular, and may also be in other shapes such as ellipse, racetrack, or rectangle.

Figure 3:
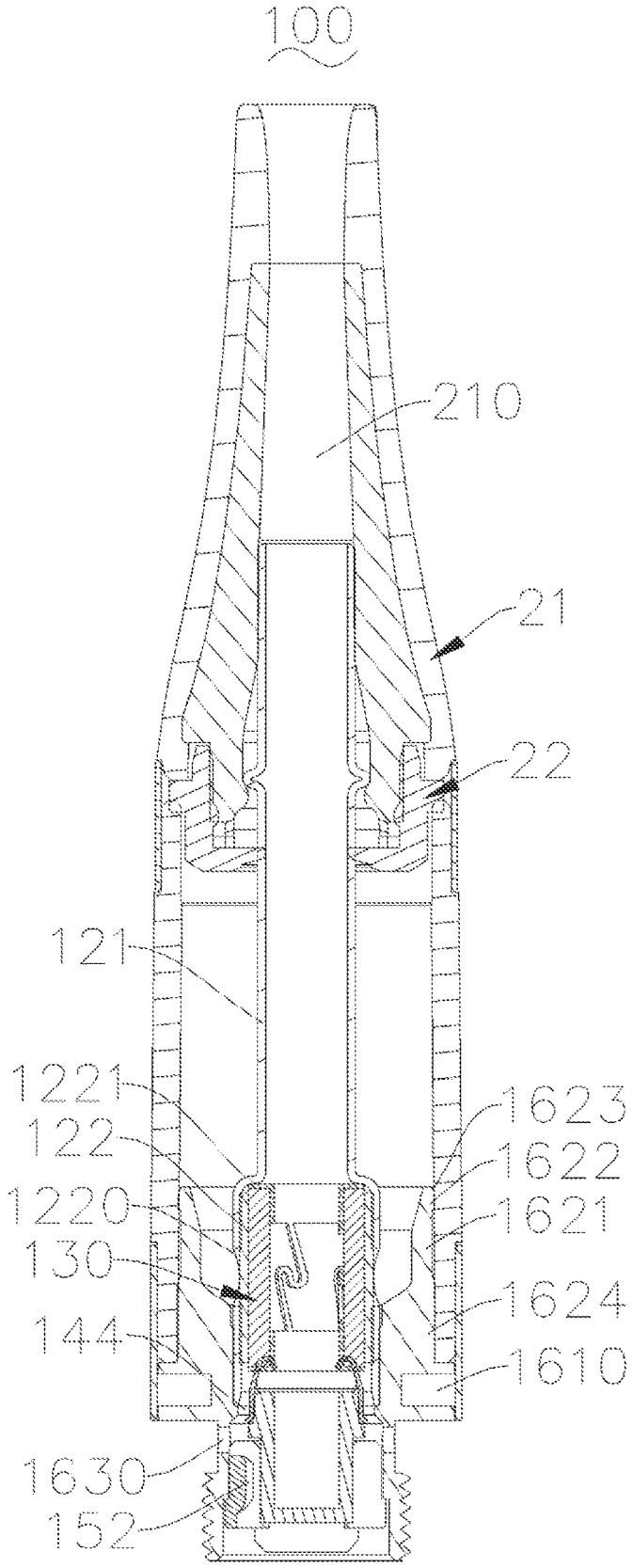
FIG. 3 is a schematic diagram of a longitudinal section of a vaporizer in FIG. 2.
Figure 4:
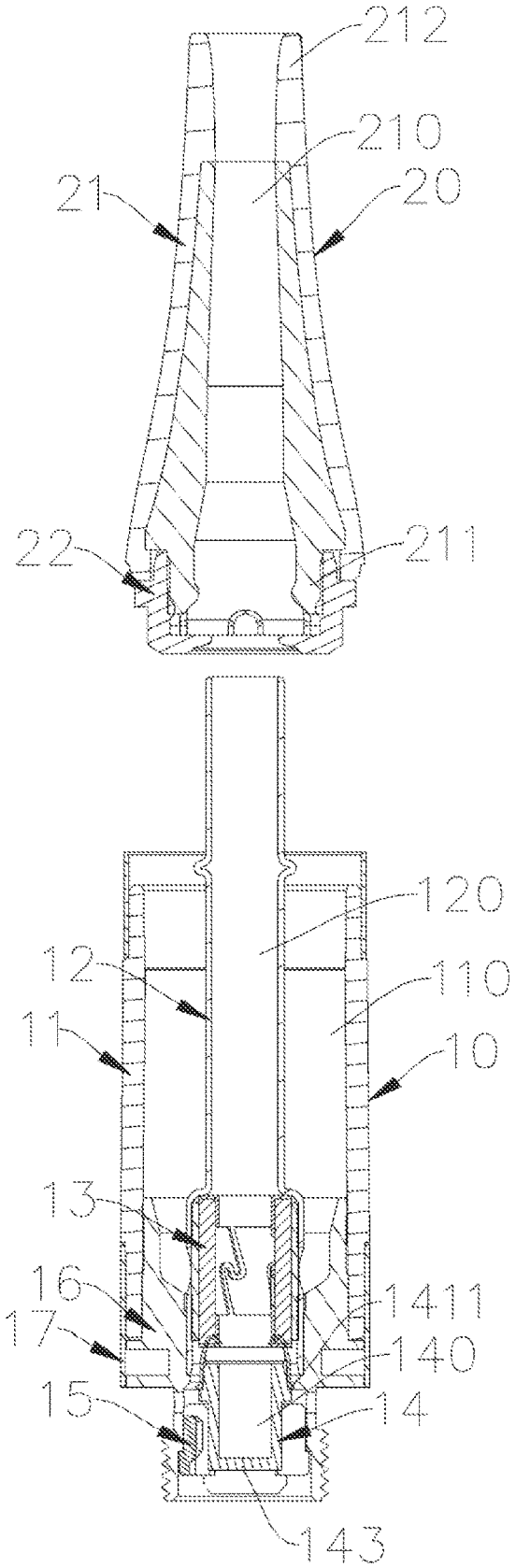
FIG. 4 is a schematic diagram of a longitudinal section of the vaporizer shown in FIG. 3.
Figure 5:
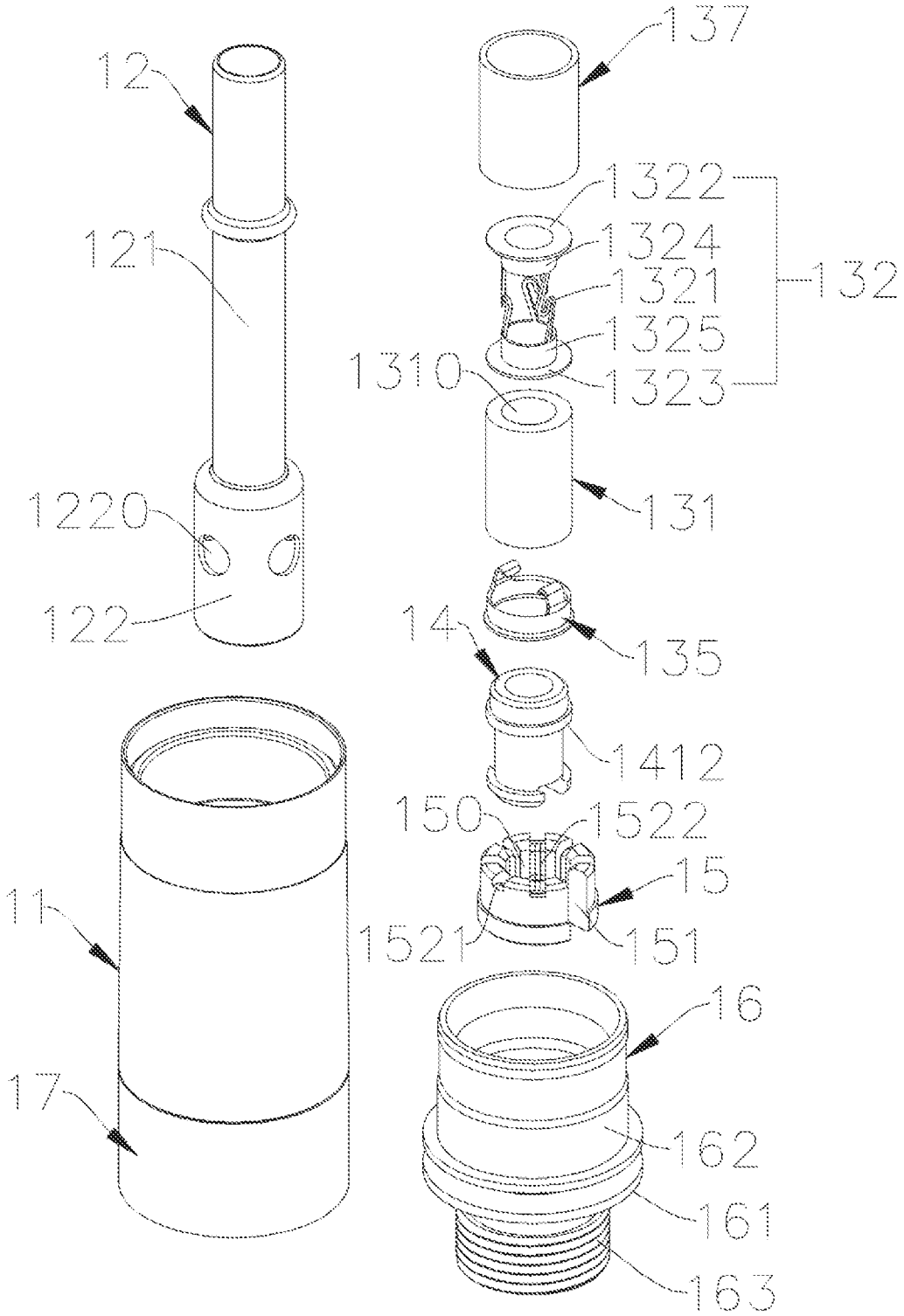
FIG. 5 is a schematic diagram of an exploded structure of a liquid storage and vaporization body in FIG. 4.

As shown in FIG. 3 to FIG. 5, the vaporizer 100 may include a liquid storage and vaporization body 10 and a mouthpiece body 20 disposed at the upper end of the liquid storage and vaporization body 10. A liquid storage cavity 110 for accommodating a liquid medium and an output channel 120 separated from the liquid storage cavity 110 and configured to deliver aerosols are formed in the liquid storage and vaporization body 10. The mouthpiece body 20 is blocked at the upper end of the liquid storage cavity 110, and has a vaping channel 210 communicated with the output channel 120 formed therein.

Specifically, the mouthpiece body 20 may include a mouthpiece 21. The vaping channel 210 is formed in the mouthpiece 21 in the longitudinal direction and may be disposed coaxially with the mouthpiece 21. In some embodiments, the mouthpiece 21 may be made of a hard material such as plastic, to improve structural stability of the vaping channel 210. Further, the mouthpiece 21 may include a blocking part 211 located at the lower part and a mouthpiece part 212 at the upper part. The mouthpiece part 212 may have a flat shape. The flat design can better fit lips, and can better gather vapor to improve vaping experience. The blocking part 211 is inserted in an opening at the upper end of the liquid storage and vaporization body 10, to sealingly block the upper end of the liquid storage cavity 110. In some embodiments, the mouthpiece body 20 may further include a seal member 22 fitted on the blocking part 211.

The seal member 22 may be made of an elastic material such as silica gel. The seal member 22 is disposed between the outer wall surface of the blocking part 211 and the cavity wall surface of the upper end of the liquid storage cavity 110 in a sealed manner.

In some embodiments, the mouthpiece body 20 may be detachably connected to the upper end of the liquid storage and vaporization body 10. In this way, the liquid medium can be added to the liquid storage cavity 110 by detaching the mouthpiece body 20 from the liquid storage and vaporization body 10, to prolong the service life of the vaporizer 100. In addition, parts of the mouthpiece body 20 and/or the liquid storage and vaporization body 10 can be replaced separately, to reduce costs. In another embodiment, the mouthpiece body 20 and the liquid storage and vaporization body 10 may alternatively be connected together in a non-detachable manner.

The liquid storage and vaporization body 10 may include a shell 11, a vent tube 12, a vaporization assembly 13, an electrode column 14 and a base 16. The vent tube 12 is disposed in the shell 11 in the longitudinal direction and may be disposed coaxially with the shell 11. The vent tube 12 may be tubular. The inner wall surface of the vent tube 12 defines an output channel 120. An annular liquid storage cavity 110 is defined between the outer wall surface of the vent tube 12 and the inner wall surface of the shell 11. The upper end of the vent tube 12 may be inserted into the mouthpiece body 20. Specifically, the upper end of the vent tube 12 may penetrate through the seal member 22 and be inserted into the mouthpiece 21. The seal member 22 is configured to sealingly wrap on the vent tube 12. The mouthpiece 21 is used for ensuring the reliability of the connection between the vent tube 12 and the mouthpiece body 20.

The vaporization assembly 13 is accommodated in the vent tube 12 and may be disposed coaxially with the vent tube 12. The vaporization assembly 13 includes a vaporization core 130. The vaporization core 130 includes a liquid absorbing body 131 and a heating element 132 in contact with the liquid absorbing body 131. The liquid absorbing body 131 is in fluid communication with the liquid storage cavity 110, and is configured to absorb the liquid medium from the liquid storage cavity 110 and deliver the liquid medium to the heating element 132. Specifically, in this embodiment, the liquid absorbing body 131 is a porous ceramic, and can absorb the liquid medium from the liquid storage cavity 110 through infiltration and capillary effect of an internal microporous structure of the liquid absorbing body 131. The liquid absorbing body 131 may be cylindrical, and is internally provided with a vaporization cavity 1310 running through the liquid absorbing body in the longitudinal direction. The vaporization cavity 1310 is communicated with the lower end of the output channel 120 and may be disposed coaxially with the output channel 120.

It may be understood that in other embodiments, the liquid absorbing body 131 may alternatively be made of other porous materials, not limited to a porous ceramic material.

The heating element 132 may be a heating film, and may be formed on a blank of the liquid absorbing body 131 by silk screen printing, printing, spraying or the like, then sintered together with the liquid absorbing body 131 and formed. Alternatively, the heating element 132 may be an independently formed metal heating sheet or metal heating wire. The heating element 132 includes at least one heating track 1321 and two end surface electrodes 1322 and 1323 connected to two poles of the at least one heating track 1321. The at least one heating track 1321 may be disposed in the inner wall surface of the liquid absorbing body 131 to generate heat after energized, to heat and vaporize the liquid medium adsorbed by the liquid absorbing body 131. The two end surface electrodes 1322 and 1323 are respectively disposed on the upper end surface and the lower end surface of the liquid absorbing body 131 for external connection of an external power supply. Further, in other embodiments, the heating element 132 may also include two connection electrodes 1324 and 1325. The two connection electrodes 1324 and 1325 are respectively disposed at the upper and lower ends of the inner wall surface of the liquid absorbing body 131. The upper and lower ends of the heating track 1321 are connected to the two end surface electrodes 1322 and 1323 through the two connection electrodes 1324 and 1325, respectively. It may be understood that in other embodiments, the heating element 132 may alternatively not include the two connection electrodes 1324 and 1325. In other words, the upper and lower ends of the heating track 1321 may alternatively be directly connected to the two end surface electrodes 1322 and 1323.

In this embodiment, the heating element 132 includes three parallel heating tracks 1321. The three heating tracks 1321 are evenly arranged at intervals in the circumferential direction of the liquid absorbing body 131. This is beneficial to uniformly heat the liquid medium adsorbed by the liquid absorbing body 131. Each heating track 1321 extends in the axial direction of the heating element 132 in a non-linear manner, such as extending along a curved or zigzag path, to increase the heating area of the heating track 1321. The two connection electrodes 1324 and 1325 are cylindrical, and the two end surface electrodes 1322 and 1323 are thin annular discs. The upper end of the connection electrode 1324 is connected to the end surface electrode 1322, and the lower end is connected to the upper ends of the three heating tracks 1321. The lower end of the connection electrode 1325 is connected to the end surface electrode 1323, and the upper end is connected to the lower end of the three heating tracks 1321.

It may be understood that in other embodiments, the quantity of the heating tracks 1321 may be one, two, or three or more, and/or, the heating tracks 1321 may also extend along a straight line.

In some embodiments, the vaporization core 130 may further include a liquid guide cotton 137 fitted outside the liquid absorbing body 131 and in contact with the liquid absorbing body 131. The liquid medium in the liquid storage cavity 110 is adsorbed by the liquid guide cotton 137 and distributed in the liquid guide cotton 137, and then delivered to the liquid absorbing body 131. In this way, the liquid guide is faster and more uniform.

The base 16 is disposed at the lower end of the shell 11 and blocks the lower end of the liquid storage cavity 110. In some embodiments, both the base 16 and the vent tube 12 are electrically conductive. The end surface electrode 1322 can be directly or indirectly electrically connected to the vent tube 12, to electrically connected to the base 16. The electrode column 14 is inserted into the base 16 in the longitudinal direction and is electrically insulated from the base 16. The end surface electrode 1323 is directly or indirectly electrically connected to the electrode column 14.

In some embodiments, the base 16 may be integrally formed by a metal material, and may be fixed in the shell 11 by riveting or the like. The base 16 may include a base part 161, an insertion part 162 extending upward from the upper end surface of the base part 161, and a connecting part 163 extending downward from the lower end surface of the base part 161. The base part 161 may be cylindrical. The upper end surface of the base part 161 may abut against the lower end surface of the shell 11. The outer diameter of the base part 161 may be the same as the outer diameter of the lower end of the shell 11. The connecting part 163 may be cylindrical. The outer wall surface of the connecting part 163 is provided with a threaded structure for threaded connection with the power supply device 200. The outer diameter of the connecting part 163 may be smaller than the outer diameter of the base part 161. At least one air inlet hole 1630 may also be formed in the side wall that is at the upper part of the connecting part 163 and that is not provided with the threaded structure, to allow outside air to enter the vaporization cavity 1310. In this embodiment, there are a plurality of air inlet holes 1630, and the plurality of air inlet holes 1630 are evenly arranged at intervals in the circumferential direction of the connecting part 163.

The insertion part 162 may be cylindrical and inserted into the lower part of the shell 11. At least part of the outer peripheral surface of the insertion part 162 is sealingly fitted to the inner wall surface of the shell 11, to sealingly block the lower end of the liquid storage cavity 110. Specifically, in this embodiment, the insertion part 162 may include a body part 1621 and a sealing boss 1622 extending outward from the body part 1621. The outer wall surface of the body part 1621 may be in a clearance fit with the inner wall surface of the shell 11. The body part 1621 has a longer length in the axial direction, so that force required for mounting the base 16 into the shell 11 is reduced. The sealing boss 1622 is in an interference fit with the inner wall surface of the shell 11. The sealing effect is enhanced by the interference fit. The axial length of the sealing boss 1622 is short, so that force required for mounting the base 16 into the shell 11 is reduced while sealing performance is ensured. In addition, the sealing boss 1622 may be disposed on the top of the body part 1621 or close to the top of the body part 1621, so that less liquid medium penetrates between the outer wall surface of the insertion part 162 and the inner wall surface of the shell 11, thereby achieving a better liquid leakage prevention effect. A guide bevel 1623 may also be formed at the upper end of the sealing boss 1622. The outer diameter of the guide bevel 1623 gradually decreases from bottom to top, and the outer diameter of the upper end of the guide bevel 1623 is smaller than the inner diameter of the shell 11, so that the sealing boss 1622 can be easily guided into the shell 11. It may be understood that in other embodiments, the outer wall surface of the body part 1621 may alternatively be in a transition fit with the inner wall surface of the shell 11. In some other embodiments, the sealing boss 1622 may alternatively be located at the middle or lower part of the body part 1621.

Further, the insertion part 162 may further include a joint part 1624 connected to the lower end of the body part 1621. The outer wall surface of the joint part 1624 may be in an interference fit with the inner wall surface of the shell 11. This can further improve the liquid leakage prevention effect, and can make fixation of the insertion part 162 in the shell 11 more reliable. In addition, the insertion part 162 is located at the opening of the shell 11, and has little influence on the force required for mounting the base 16 into the shell 11. It may be understood that in other embodiments, the outer wall surface of the joint part 1624 and the inner wall surface of the shell 11 may alternatively be in a transition fit or a clearance fit.

In some embodiments, a heat insulation space 1610 may also be formed on the base 16. The heat insulation space 1610 can play a role of heat insulation and heat preservation, to reduce heat transferred outward by the base 16 and reduce heat loss.

In this embodiment, the heat insulation space 1610 is an annular groove, which is formed by radial inward recession of the outer peripheral surface of the base part 161. Because the outer diameter of the base part 161 is the largest, the provision of the heat insulation space 1610 on the base part 161 enables the heat insulation space 1610 to have large volumetric space, so as to improve heat insulation effect and reduce heat transferred to the connecting part 163, thereby reducing heat transferred to the power supply device 200. It may be understood that in other embodiments, the heat insulation space 1610 may alternatively be in other shapes, such as a shape of petals arranged at intervals.

In some other embodiments, the heat insulation space 1610 may alternatively be wholly or partially formed on the insertion part 162 or the connecting part 163. In addition, the heat insulation space 1610 may also be filled with heat insulation materials to further improve the heat insulation effect.

In some embodiments, the liquid storage and vaporization body 10 may also include a fixing sleeve 17. The fixing sleeve 17 is cylindrical and fitted at the lower end of the shell 11 and outside the base part 161. This can strengthen the fixation between the shell 11 and the base 16, and can also seal the heat insulation space 1610.

The vent tube 12 may be integrally formed by a metal material, and may include a first tube section 121 and a second tube section 122 connected to the lower end of the first tube section 121. Both the inner diameter and the outer diameter of the first tube section 121 are smaller than the inner diameter and the outer diameter of the second tube section 122. The outer diameter of the first tube section 121 is small, so that the liquid storage cavity 110 formed between the outer wall surface of the first tube section 121 and the inner wall surface of the shell 11 has a larger liquid storage space. The lower end of the second tube section 122 is inserted in the base 16, and the outer wall surface of the second tube section 122 is in electrical contact with the inner wall surface of the base 16. It may be understood that in other embodiments, the vent tube 12 and/or the base 16 may alternatively be made of an electrically conductive or insulating material, and then coated with an electrically conductive layer on a required electrically conductive part to achieve an electrically conductive function.

The vaporization core 130 is accommodated in the second tube section 122, and at least one liquid inlet 1220 is formed in the side wall of the second tube section 122, to enable the liquid medium in the liquid storage cavity 110 to flow into the vaporization core 130 through the at least one liquid inlet 1220. In this embodiment, there are a plurality of liquid inlets 1220, and the plurality of liquid inlets 1220 are evenly arranged at intervals in the circumferential direction of the second tube section 122, to facilitate uniform and sufficient liquid supply to the liquid absorbing body 131. The inner diameter of the second tube section 122 may be slightly smaller than the outer diameter of the liquid guide cotton 137, to enable the second tube section 122 to tightly clamp the liquid guide cotton 137. In this way, the vaporization core 130 can be fixed, and liquid leakage can be reduced through sealing. It may be understood that in other embodiments, the inner diameter of the second tube section 122 may alternatively be equal to or larger than the outer diameter of the liquid guide cotton 137.

The upper end of the second tube section 122 has a conductive end surface 1221. The conductive end surface 1221 directly or indirectly abuts against and is electrically connected to the end surface electrode 1322. In this embodiment, the conductive end surface 1221 directly abuts against and is electrically connected to the end surface electrode 1322.

In some embodiments, the vaporization assembly 13 further includes a conductive connector 135. The electrode column 14 is electrically connected to the end surface electrode 1323 through the conductive connector 135. Further, the electrode column 14 has a conductive end surface 1411. The conductive connector 135 is disposed between the conductive end surface 1411 and the end surface electrode 1323. The conductive connector 135 may include a body part 1351 and at least one elastic arm 1352 connected to the body part 1351. The at least one elastic arm 1352 may be in elastic and electrical contact with the conductive end surface 1411 or the end surface electrode 1323. The conductive connector 135 may produce certain elastic deformation in the longitudinal direction, to cause the vaporization core 130 to produce certain elastic floating in the longitudinal direction. As a result, a reliable electrical connection is still formed between the conductive end surface 1411 and the end surface electrode 1323 in the case of low product uniformity. In addition, due to the elasticity of the conductive connector 135, the porous ceramic liquid absorbing body can be prevented from being damaged during installation.

Specifically, in this embodiment, the outer wall surface of the electrode column 14 protrudes outward to form a circular flange 1412. A conductive end surface 1411 is formed on the upper end surface of the flange 1412. The center part of the top surface of the electrode column 14 may extend downwards to form a center hole 140. The center hole 140 is located under the vaporization cavity 1310 and can receive and accommodate certain leaked liquid or condensate. The lower end of the center hole 140 has a bottom wall 143. The bottom wall 143 seals the lower end of the center hole 140, to prevent leakage of the leaked liquid or condensate in the center hole 140 to the outside. A circular vent gap 144 is formed between the outer wall surface of the electrode column 14 and the inner wall surface of the base 16. The air inlet hole 1630 is communicated with vaporization cavity 1310 through the vent gap 144. There is a spacing between the upper end surface of the electrode column 14 and the lower end surface of the vaporization core 130. The spacing can play a role of heat insulation and air circulation.

The spacing can prevent the vaporization core 130 from being in direct contact with the electrode column 14, and prevent heat of the vaporization core 130 from being directly transferred to the electrode column 14, thereby achieving heat insulation. In addition, the spacing also communicates the vent gap 144 with the vaporization cavity 1310.

Figure 6:
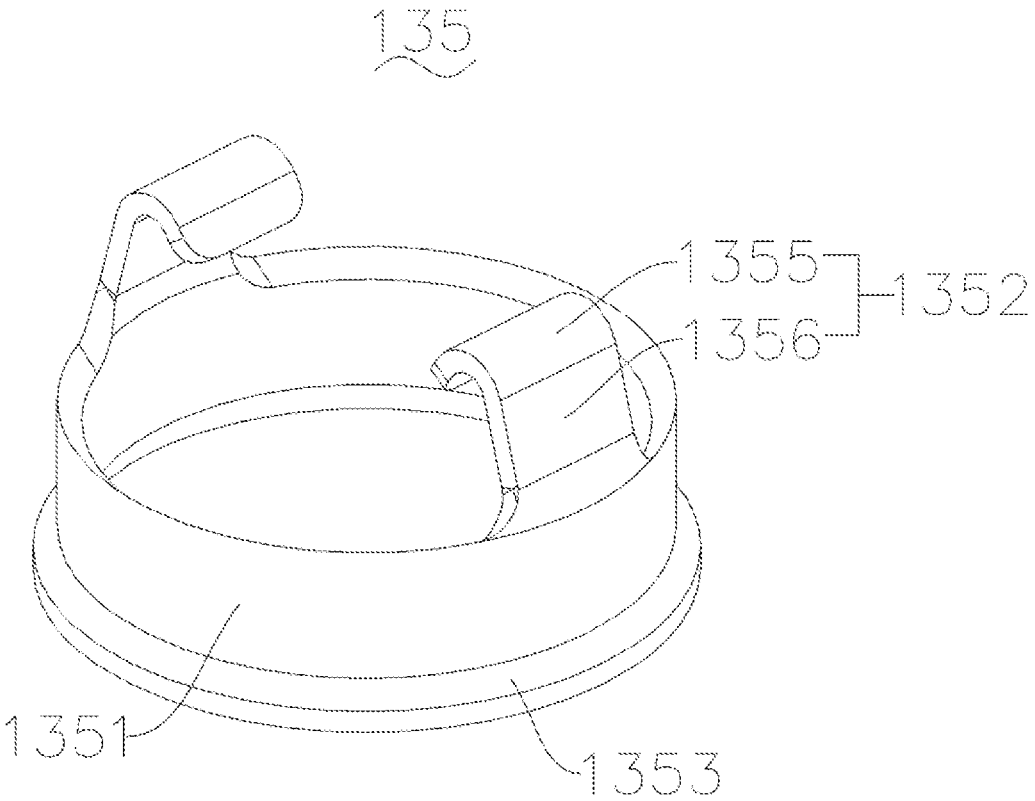
FIG. 6 is a schematic diagram of a three-dimensional structure of a conductive connector in FIG. 5.

As shown in FIG. 6, the conductive connector 135 may be integrally formed with a metal material such as phosphor copper or 316 stainless steel. The surface of the conductive connector 135 may also be provided with a coating layer such as a gold coating or a silver coating, to improve conductivity.

The body part 1351 is cylindrical and is fitted on the upper part of the electrode column 14. The lower end of the body part 1351 abuts against the conductive end surface 1411 and is in electrical contact with the conductive end surface 1411. The inner wall surface of the body part 1351 is in electrical contact with the outer wall surface of the electrode column 14. In this way, the fixation of the conductive connector 135 on the electrode column 14 is more reliable, and the electrical connection between the conductive connector 135 and the electrode column 14 is more reliable. A flare structure 1353 may also be provided at the bottom of the body part 1351. The diameter of the flare structure 1353 gradually decreases from bottom to top, to facilitate the fitting of the body part 1351 onto the electrode column 14. In addition, the outer surface of the upper end of the electrode column 14 may also be formed with a guide bevel, to facilitate the fitting of the body part 1351 onto the electrode column 14.

Preferably, there are a plurality of elastic arms 1352. The plurality of elastic arms 1352 are evenly arranged at intervals in the circumferential direction of the body part 1351. Each elastic arm 1352 includes a conducting part 1355 configured to elastically abut against and be electrically connected to the end surface electrode 1323 and a connecting arm 1356 connecting the conducting part 1355 and the body part 1351. In some embodiments, the quantity of the elastic arms 1352 may range from two to four. This can ensure the width of the elastic arms 1352 to enable the elastic arms 1352 to be in electrical contact with the end surface electrode 1323 more stably, and can meet requirements of a manufacturing process and facilitate manufacturing. Specifically, in this embodiment, the quantity of the elastic arms 1352 is two.

Further, in this embodiment, the connecting arm 1356 is sheet-shaped and has good elasticity, and may extend upward from the top surface of the body part 1351 and obliquely toward the center of the body part 1351. The conducting part 1355 may roughly have a spoon-shaped structure, and may be formed by the end of the connecting arm 1356 away from the body part 1351 bending toward the inside of the body part 1351, that is, the bowl of the spoon faces the inside of the body part 1351. The bevel of the spoon-shaped structure has a guiding effect, and the bottom of the spoon is an arc surface, to be in better contact with the end surface electrode 1323. It may be understood that in other embodiments, the connecting arm 1356 may alternatively be inclined away from the center of the body part 1351, and/or, the bowl of the scoop of the conducting part 1355 may alternatively face the outside of the body part 1351.

It may be understood that in other embodiments, the conductive end surface 1411 may also be formed on the upper end surface of the electrode column 14. In some other embodiments, the body part 1351 may abut against and be electrically connected to the end surface electrode 1323, and the elastic arm 1352 may elastically abut against and be electrically connected to the conductive end surface 1411.

As shown in FIG. 3 to FIG. 5, the electrode column 14 and the base 16 may be insulatingly and sealingly connected through an insulating sleeve 15. Specifically, the insulating sleeve 15 may be made of an insulating material such as silica gel or plastic. The insulating sleeve 15 is disposed in the connecting part 163 in the longitudinal direction. The electrode column 14 is disposed in the insulating sleeve 15 in the longitudinal direction. The lower end surface of the flange 1412 may abut against the upper end surface of the insulating sleeve 15. In some embodiments, the insulating sleeve 15 may be annular with an opening on one side. A through hole 150 is formed in and runs through the insulating sleeve 15 in the longitudinal direction. The electrode column 14 is inserted into the through hole 150. A side opening 151 is formed on one circumferential side of the insulating sleeve 15. The side opening 151 runs through the upper and lower sides of the insulating sleeve 15, to facilitate the mounting of the electrode column 14 into the insulating sleeve 15.

Further, at least one vent passage 152 for air circulation may also be formed on the insulating sleeve 15. The at least one vent passage 152 communicates the vent gap 144 with the outside. In one embodiment, the vent passage 152 may be used for inflow of air, that is, allowing outside air to enter the vent gap 144. In this case, an air inlet hole 1630 may or may not be provided on the base 16. In another embodiment, the vent passage 152 may be configured to communicate the vent gap 144 with an airflow sensor in the power supply device 200, to enable the power supply device 200 to be turned on through the airflow sensor to supply power to the vaporizer 100 during vaping.

in this embodiment, there are a plurality of vent passages 152 evenly arranged at intervals in the circumferential direction of the insulating sleeve 15.

Each vent passage 152 includes a vent 1521 formed in the upper end surface of the insulating sleeve 15 and a vent groove 1522 communicated with the vent 1521 and formed in the longitudinal direction in the inner wall surface of the insulating sleeve 15. It may be understood that in other embodiments, the vent passages 152 may alternatively be formed on the outer wall surface of the insulating sleeve 15.

In some other embodiments, the vent groove 1522 may also extend in a non-linear shape, such as a spiral shape, an S shape, or a zigzag shape.

It may be understood that the foregoing technical features can be used in any combination without limitation.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporizer, comprising:

a base;

an electrode column inserted in the base in a longitudinal direction; and an insulating sleeve disposed between the electrode column and the base so as to electrically insulate the electrode column from the base, the insulating sleeve having an upper end and a lower end, wherein a side opening is provided in a side wall of the insulating sleeve, the side opening running through an inner side and an outer side of the side wall and through the upper end and the lower end of the insulating sleeve, and wherein at least one vent passage is formed on the insulating sleeve.

2. The vaporizer of claim 1, wherein an extension direction of the side opening is parallel to an extension direction of the insulating sleeve.

3. The vaporizer of claim 1, wherein the at least one vent passage comprises a plurality of vent passages, and wherein the plurality of vent passages are evenly arranged at intervals in a circumferential direction of the insulating sleeve.

4. The vaporizer of claim 1, wherein the at least one vent passage comprises at least one vent groove formed on an inner wall surface of the insulating sleeve.

5. The vaporizer of claim 1, wherein an upper end of the electrode column extends out of the insulating sleeve, wherein an annular vent gap is formed between an outer wall surface of the upper end of the electrode column and an inner wall surface of the base, and wherein the at least one vent passage communicates with the annular vent gap.

6. The vaporizer of claim 1, wherein an outer wall surface of the electrode column protrudes outward to form a flange, and wherein the flange abuts against an upper end surface of the insulating sleeve.

7. The vaporizer of claim 1, further comprising:

a shell;

a vent tube inserted in the shell; and a vaporization core disposed in the vent tube, wherein the base is at least partially inserted into a lower end of the shell, and wherein one pole of the vaporization core is electrically connected to the electrode column.

8. The vaporizer of claim 7, wherein a lower end of the vent tube is inserted into the base.

9. The vaporizer of claim 8, wherein the vent tube and the base are electrically conductive, and wherein another pole of the vaporization core is electrically connected to the vent tube and the base.

10. An electronic vaporization device, comprising:

the vaporizer of claim 1.

11. A vaporizer, comprising:

a base;

an electrode column inserted in the base in a longitudinal direction; and an insulating sleeve disposed between the electrode column and the base so as to electrically insulate the electrode column from the base, the insulating sleeve having an upper end and a lower end, wherein a side opening is provided in a side wall of the insulating sleeve, the side opening running through an inner side and an outer side of the side wall and through the upper end and the lower end of the insulating sleeve, wherein an outer wall surface of the electrode column protrudes outward to form a flange, and wherein the flange abuts against an upper end surface of the insulating sleeve.

12. The vaporizer of claim 11, wherein an extension direction of the side opening is parallel to an extension direction of the insulating sleeve.

13. The vaporizer of claim 11, further comprising:

a shell;

a vent tube inserted in the shell; and a vaporization core disposed in the vent tube, wherein the base is at least partially inserted into a lower end of the shell, and wherein one pole of the vaporization core is electrically connected to the electrode column.

14. The vaporizer of claim 13, wherein a lower end of the vent tube is inserted into the base.

15. The vaporizer of claim 14, wherein the vent tube and the base are electrically conductive, and wherein another pole of the vaporization core is electrically connected to the vent tube and the base.

16. An electronic vaporization device, comprising:

the vaporizer of claim 11.

* * * * *